US009782317B2

(12) United States Patent
Mount

(10) Patent No.: US 9,782,317 B2
(45) Date of Patent: Oct. 10, 2017

(54) HEAD SUPPORT DEVICE

(71) Applicant: Mary Madeline Mount, Etobicoke (CA)

(72) Inventor: Mary Madeline Mount, Etobicoke (CA)

( * ) Notice: Subject to any disclaimer, the term of this patent is extended or adjusted under 35 U.S.C. 154(b) by 0 days.

(21) Appl. No.: 14/555,778

(22) Filed: Nov. 28, 2014

(65) Prior Publication Data

US 2016/0151221 A1 Jun. 2, 2016

(51) Int. Cl.

| | |
|---|---|
| ***A47C 7/38*** | (2006.01) |
| ***A47C 20/00*** | (2006.01) |
| ***A61G 13/12*** | (2006.01) |
| ***A61G 15/12*** | (2006.01) |
| ***A47C 20/02*** | (2006.01) |
| ***A47C 20/04*** | (2006.01) |

(52) U.S. Cl.

CPC ..... *A61G 13/121* (2013.01); *A47C 7/38* (2013.01); *A47C 20/02* (2013.01); *A47C 20/047* (2013.01); *A61G 15/125* (2013.01); *A61G 2200/322* (2013.01); *A61G 2200/325* (2013.01); *A61G 2200/327* (2013.01); *A61G 2200/34* (2013.01)

(58) Field of Classification Search

CPC ..... A47G 9/10; A47G 9/1009; A47G 9/1054; A47C 7/383; A47C 7/38; A47C 20/00; A47C 20/02; A47C 20/026

USPC ... 5/640, 636, 638, 643, 622, 621, 658, 659, 5/661

See application file for complete search history.

(56) References Cited

U.S. PATENT DOCUMENTS

| | | | | |
|---|---|---|---|---|
| 3,608,103 | A | 9/1971 | Seid | |
| 4,584,731 | A | 4/1986 | Carter | |
| 4,917,363 | A | 4/1990 | Evans et al. | |
| 5,177,823 | A * | 1/1993 | Riach | A47C 7/38 297/408 |
| 5,337,429 | A | 8/1994 | Tucker | |
| 5,427,436 | A * | 6/1995 | Lloyd | A47C 7/38 297/408 |
| 5,661,860 | A * | 9/1997 | Heitz | A47C 20/026 5/630 |
| 5,971,485 | A * | 10/1999 | Clark | A61G 13/009 297/195.11 |
| 6,081,947 | A | 7/2000 | Disher | |
| 6,148,460 | A | 11/2000 | Fried et al. | |
| 6,151,734 | A | 11/2000 | Lawrie | |
| 6,397,414 | B1 * | 6/2002 | Lloyd | A47C 20/026 297/900 |
| 6,718,581 | B2 * | 4/2004 | Riach | A61B 6/0421 5/607 |
| 6,758,447 | B2 * | 7/2004 | Tinsley | A61G 13/12 248/118 |

(Continued)

FOREIGN PATENT DOCUMENTS

| | | |
|---|---|---|
| CA | 1209455 | 8/1986 |
| CA | 2390038 | 4/2002 |

*Primary Examiner* — Robert G Santos

(74) *Attorney, Agent, or Firm* — Gilbert's LLP; Matthew D. Pavell

(57) ABSTRACT

A head support device for use with a bed includes a head-receiving component; a base component adapted to rest on a stable surface; a vertically-oriented spine component extending upwards from the base component to the head-receiving component; and at least one bed-connection structure extending horizontally from an intermediate position along the spine component.

10 Claims, 7 Drawing Sheets

(56) References Cited

U.S. PATENT DOCUMENTS 6,857,149 B2 * 2/2005 Hoggatt ..... A47C 20/026 5/632
6,928,679 B1 8/2005 Gross
7,036,168 B1 5/2006 Knickerbocker
7,080,420 B2 * 7/2006 Damron ..... A61G 13/121 5/622
7,093,313 B2 * 8/2006 DeBraal ..... A61G 13/121 248/292.12
7,306,612 B1 12/2007 Landa
7,424,759 B2 * 9/2008 Damron ..... A61G 13/121 5/640
7,610,639 B2 * 11/2009 Roleder ..... A47C 20/026 5/622
7,636,968 B2 * 12/2009 Roleder ..... A47C 20/026 5/490
7,640,609 B2 * 1/2010 Roleder ..... A47C 20/026 5/622
7,761,943 B2 * 7/2010 Roleder ..... A61G 13/12 5/622
7,805,788 B1 * 10/2010 Proctor ..... A61G 7/0755 5/648
7,979,933 B2 * 7/2011 Roleder ..... A47C 20/026 5/622
7,979,934 B2 * 7/2011 Roleder ..... A47C 20/026 5/622
8,167,587 B2 5/2012 Dorsey et al.
8,370,976 B2 * 2/2013 Matt ..... A47C 20/026 5/638
D683,463 S * 5/2013 Huggins ..... D24/184
D705,431 S * 5/2014 Abramson ..... D24/184
9,150,130 B2 * 10/2015 Jackow ..... B60N 2/4805
9,226,587 B2 * 1/2016 Halimi ..... A47C 16/00
2002/0096929 A1 * 7/2002 Showerman ..... A47C 7/38 297/423.12
2002/0100846 A1 * 8/2002 Tinsley ..... A61G 13/12 248/118
2002/0184706 A1 * 12/2002 Riach ..... A61B 6/0421 5/632
2003/0172462 A1 * 9/2003 Hoggatt ..... A47C 20/026 5/657
2005/0067875 A1 * 3/2005 DeBraal ..... A61G 13/121 297/409
2006/0053557 A1 * 3/2006 Damron ..... A61G 13/121 5/640
2006/0225214 A1 * 10/2006 Damron ..... A61G 13/121 5/640
2006/0288484 A1 * 12/2006 Roleder ..... A47C 20/026 5/622
2006/0288487 A1 * 12/2006 Roleder ..... A47C 20/026 5/638
2006/0290193 A1 * 12/2006 Roleder ..... A47C 20/026 297/397
2006/0290194 A1 * 12/2006 Roleder ..... A47C 20/026 297/397
2006/0290195 A1 * 12/2006 Roleder ..... A47C 20/026 297/397
2009/0077749 A1 * 3/2009 Roleder ..... A61G 13/12 5/638
2011/0296620 A1 * 12/2011 Gard ..... A61G 13/121 5/661
2012/0278993 A1 11/2012 Gard et al.
2013/0232696 A1 * 9/2013 Halimi ..... A47C 16/00 5/640
2015/0001905 A1 * 1/2015 Jackow ..... B60N 2/4805 297/397
2016/0081482 A1 * 3/2016 Schumacher ..... A47G 9/1054 5/640
2016/0151221 A1 * 6/2016 Mount ..... A47C 7/38 5/638

* cited by examiner

HEAD SUPPORT DEVICE

FIELD OF THE INVENTION

Embodiments of the present invention relate generally to physical therapy and comfort, and more particularly to a head support device that can interface with a bed.

BACKGROUND OF THE INVENTION

Treatment by a massage therapist can provide significant relief to a patient with back and neck pain. Massage and other physical therapists typically have specialty cushioned tables upon which the patient can lie during treatment, and from the end of which extends a cantilevered head support device for carefully supporting the patient's head during treatment in a desired way. When the patient returns home and lies down on his or her bed, however, the patient does not typically have the benefit of such a head support device, and instead must simply lay his or her head down on a pillow. After a sleep session, through head and neck interaction with the pillow where the neck and spine are not well-aligned, some of the relief gained from the visit to the therapist can be undone.

Various head support devices have been proposed for interfacing with a patient's bed in ways that are intended to provide the benefits of a specialty massage table using a normal "sleeping" bed, for resting or for use during kinds of treatment at home. For example, see U.S. Pat. No. 6,928,679 to Gross, U.S. Pat. No. 7,036,168 to Knickerbocker, U.S. Pat. No. 6,151,734 to Lawrie, U.S. Pat. No. 6,148,460 to Fried et al., U.S. Pat. No. 8,176,587 to Matt et al. U.S. Patent Application Publication No. US 2012/0278993 to Gard et al., U.S. Pat. No. 6,081,947 to Disher, U.S. Pat. No. 7,306,612 to Landa, U.S. Pat. No. 5,337,429 to Tucker, U.S. Pat. No. 4,917,363 to Evans et al., U.S. Pat. No. 4,584,731 to Carter, U.S. Pat. No. 3,608,103 to Seid, Canadian Patent No. 1,209,455 to Younger et al., and Canadian Patent No. 2,390,038 to Smith et al.

Various head support devices have disadvantages, such as lack of adjustability, a difficulty keeping to a particular position alongside a bed and a difficulty keeping proximate to the bed while a patient turns within or gets out of the bed.

It is an object of an aspect of the following to address these and other disadvantages.

SUMMARY OF THE INVENTION

In accordance with an aspect, there is provided a head support device for use with a bed having a footboard, the device comprising a head-receiving component; a base component adapted to stably rest on a same surface as does the bed; a vertically-oriented, height-adjustable spine component extending upwards from the base component to the head-receiving component; and at least one bed-connection structure extending horizontally from an intermediate position along the spine component and being stepped from the horizontal by extending downwards along an inward-facing surface of the footboard, and then again horizontally away from the spine component along the bottom of a mattress or box spring of the bed; wherein the head-receiving component comprises levelling structure associated with an axis perpendicular to and supported by the spine component, the levelling structure extending away from the axis to be both rotatable through a range of rotational positions with respect to the axis and, at each one of a plurality of the rotational positions, adjustable between horizontally level and off-level.

Other aspects and advantages will become apparent from the following.

BRIEF DESCRIPTION OF THE DRAWINGS

Embodiments of the invention will now be described with reference to the appended drawings in which.

DETAILED DESCRIPTION

Figure 1:
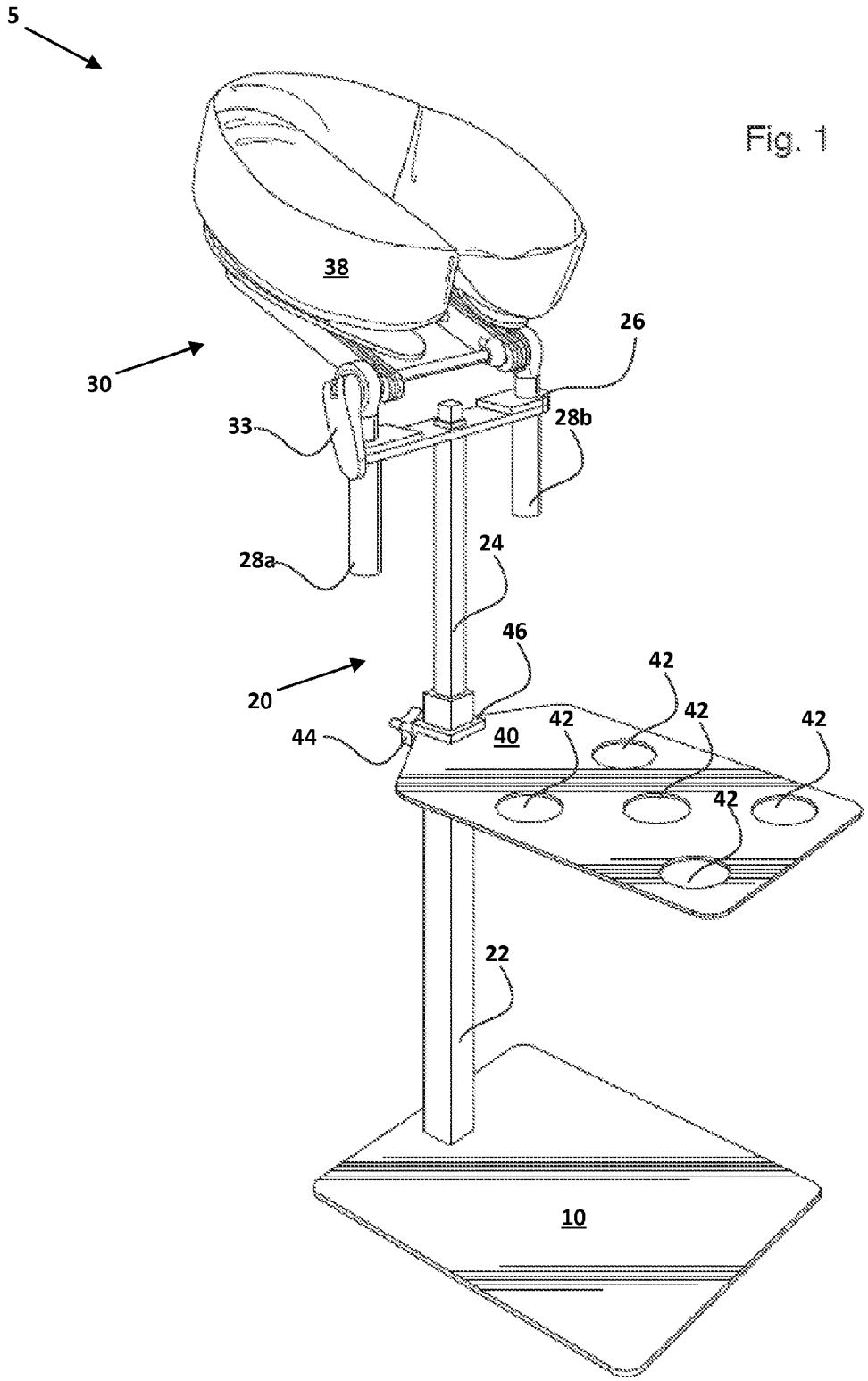
FIG. 1 is a front perspective view of a head support device, according to an embodiment.

Turning to FIG. 1, there is shown a front perspective view of a head support device 5 according to an embodiment. Head support device 5 includes as a support structure a base component 10, and a vertically-oriented spine component 20 extending upwardly from the base component 10. A head-receiving component 30 sits atop the support structure and is connected with the top of the spine component 20. Head support device 5 also includes a bed-connection structure 40 extending horizontally from an intermediate position along the spine component 20. The bed-connection structure 40 and the base component 10 combine through the spine component 20 to provide vertical positional stability to the head support device 5 despite any shifts in weight of the user on a bed as well as lateral positional stability to the head support device 5 through any shifts in weight on the head-rest component 30 itself.

In this embodiment, the base component 10 is a planar plate adapted to sit flat on a stable surface that is not the bed itself, such as a floor. Commonly, the stable surface will be on the same plane (such as on the same floor or carpet) as the surface on which the bed itself is supported. The configuration enabling the head support device 5 to sit on a stable surface that is not the bed itself helps stability of the head support device 5 to be maintained despite the mattress and/or bedspring being jostled or the user turning in bed during a typical sleep or treatment session.

In this embodiment, the spine component 20 includes a lower spine component 22 and an upper spine component 24. Lower spine component 22 forms a hollow shaft that is square in cross-section and into which upper spine component 24, which is itself a hollow shaft that is square in cross-section, is received. When received within lower spine component 22, upper spine component 24 can selectively be slid upwards or downwards thereby to enable a user to adjust the overall height of spine component 20.

In this embodiment, an internal locking mechanism (not shown) that is primarily disposed within the hollow shafts of spine component 20 may be shifted between a locked and unlocked position. The internal locking mechanism includes a button 29 that extends from the top of the upper spine component 24 and that is spring-biased to an un-depressed position corresponding to the locked position. The internal locking mechanism is biased to the locked position whereby its components bind against the interior walls of the spine component 20 to prevent undesired sliding upwards or downwards of upper spine component 24 with respect to lower spine component 22. When a user depresses button 29 against its spring bias, the internal locking mechanism is in turn shifted to its unlocked position to reduce the binding pressure on the internal walls of the spine component 20 thereby to enable upper spine component 24 to slide within lower spine component 22. In this way, height of the spine component 20 can be easily set and maintained through selective depression and subsequent release of button 29.

Affixed at the upper end of upper spine component 20 is a horizontal plate 26. The horizontal plate 26 extends outwards on two sides of the upper spine component 20 and incorporates cylindrical tubes 28*a* and 28*b* dimensioned to receive corresponding structures of the head-receiving component 30, as will be described.

In this embodiment, the bed-connection structure 40 extends from the lower spine component 22 of spine component 20. In particular, a square opening 46 through the bed-connection structure 40 corresponds in size to the external dimensions of the square cross-section of the lower spine component 22, and slidingly receives the lower spine component 22. A tension knob 44 affixed to a threaded rod can be used to thread the rod through a sidewall of the square opening 46 to bind against the lower spine component 22, thereby to allow the bed-connection structure 40, which would otherwise be free to slide upwards or downwards with respect to lower spine component 22, to remain in a particular selected position.

In this embodiment, bed-connection structure is a thin but rigid, horizontally-disposed planar plate with five holes 42 formed therethrough. The holes 42 interact with the mattress of the bed to enhance the lateral binding and thus, resistance to sliding back and forth, when received between a mattress and a box spring, as will be described in further detail.

Figure 2:
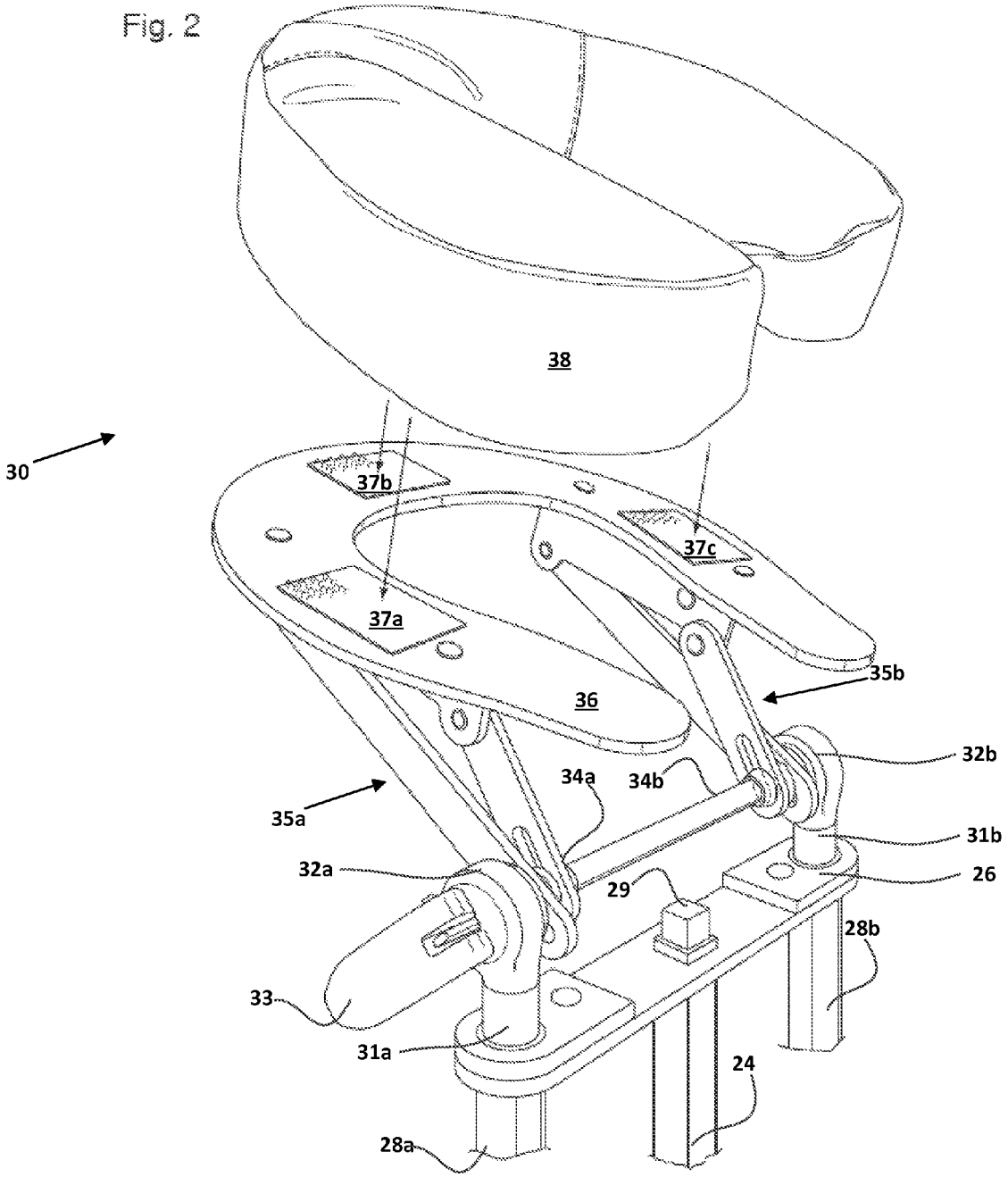
FIG. 2 is an enlarged front perspective view of a head-receiving component and a portion of a spine component of the head support device of FIG. 1.

FIG. 2 is an enlarged front perspective view of the head-receiving component 30 and a portion of the spine component 20 of the head support device 5. Head-receiving component 30 includes cylindrical rods 31*a* and 31*b* that may be received within cylindrical tubes 28*a* and 28*b*, respectively. Rods 31*a* and 31*b* extend downwards from respective hubs 32*a*, 32*b* through which a horizontal shaft 34*a* is received. At one end of the horizontal shaft 34*a* is a cam-lock 33 that can selectively be shifted between locked and unlocked positions thereby to loosen or tighten the frictional relationship between the hubs 32*a*, 32*b* and a sleeve 34*b* that loosely receives the horizontal shaft 34*a*. The horizontal shaft 34*a* also extends through a respective portion of levelling structures 35*a* and 35*b*. The levelling structures 35*a* and 35*b* are each in turn connected to the bottom of a support plate 36 which, in this embodiment, supports a U-shaped head cushion 38. In particular, in this embodiment, the head support cushion 38 has hook/loop patches affixed to its underside that align with counterpart hook/loop patches 37*a*, 37*b* and 37*c* affixed to respective positions on the top surface of support plate 36. In this way, head support cushion 38 may be maintained in a fixed position with respect to support plate 36 but selectively removed by pulling upwards to disengage respective hook/loop patches from each other.

When in the lock position, the cam-lock 33 is generally pulling hubs 32*a*, 32*b* towards each other by pulling horizontal shaft 34*a* through sleeve 34*b* thereby to pull hub 32*b* to which horizontal shaft 34*a* is connected towards hub 32*a*. Under this pulling force, flanges at opposite ends of the sleeve 34*b* bear against and frictionally bind to levelling structures 35*a*, 35*b* which, in turn, bear against and frictionally bind to respective hubs 32*a*, 32*b*. Under this condition, the levelling structures 35*a*, 35*b* are frictionally prevented from rotating about the horizontal shaft 34*a* and are thereby held in place with respect to the hubs 32*a*, 32*b* and rods 31*a* and 31*b*. Similarly, due to the pressure hubs 32*a*, 32*b* are frictionally prevented from rotating with respect to the horizontal shaft 34*a* itself. Rotation of the cam-lock 33 to its unlocked position relieves the pulling force and thereby releases the frictional binding sufficiently to enable the various components to rotate about shaft 34*a* and with respect to each other.

In this embodiment, a slight "play" or looseness in the distance between rods 31*a* and 31*b* along the shaft 34*a* that permit the locking and unlocking provides a further function. More particularly, due to this play, the cylindrical rods 31*a*, 31*b* may be received within, and bear against the inside of, corresponding cylindrical tubes 28*a* and 28*b*. In this way, when cam-lock 33 is in its unlocked position, the cylindrical rods 31*a*, 31*b* can be positioned to slide somewhat freely within corresponding cylindrical tubes 28*a* and 28*b*. However, when cam-lock 33 is in the locked position, the pressure on hubs 32*a*, 32*b* impart lateral pressure through cylindrical rods 31*a*, 31*b* to the interior of the cylindrical tubes 28*a*, 28*b* in which they are received thereby to frictionally bind against the interior of the cylindrical tubes 28*a*, and 28*b*. This frictional binding is sufficient to inhibit upward or downward sliding of cylindrical rods 31*a*, 31*b* with respect to cylindrical tubes 32*a*, 32*b* thereby to maintain a given vertical position.

The levelling structures 35*a*, 35*b* enable a user to adjust whether the support plate 36, and therefore the support cushion 38, is horizontally level, or off-level, as desired, and to allow a user to move the support cushion 38 closer to, or farther from, the bed given a particular position of base component 10 with respect to the bed. This enables a user to establish the more comfortable and supportive positioning.

Figure 4:
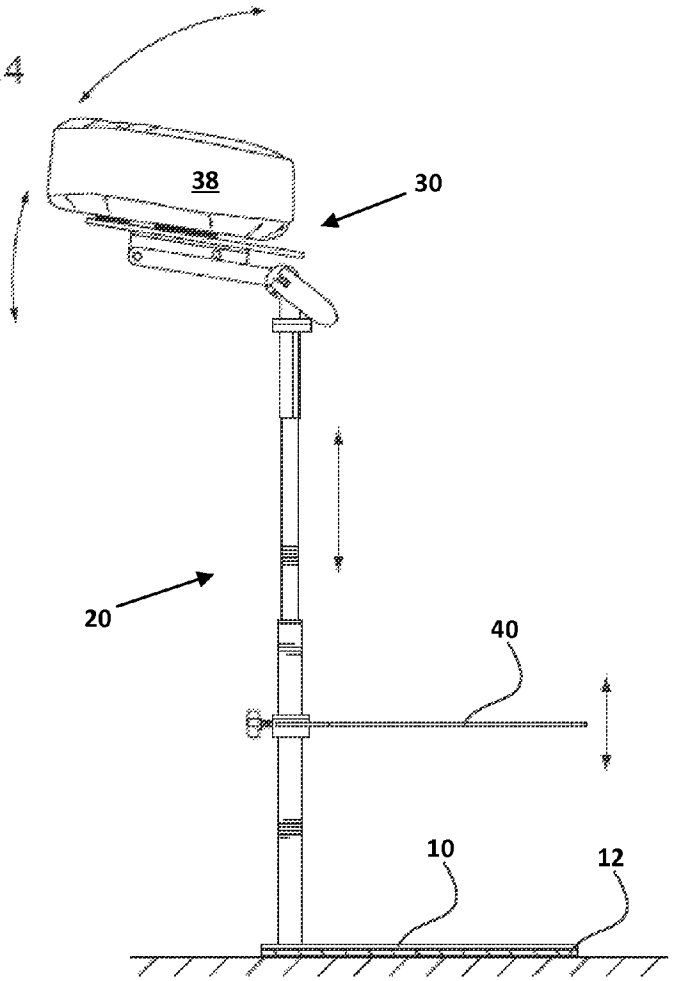
FIG. 4 is a side elevation view of the head support device of FIG. 3 in an adjusted configuration.
Figure 3:
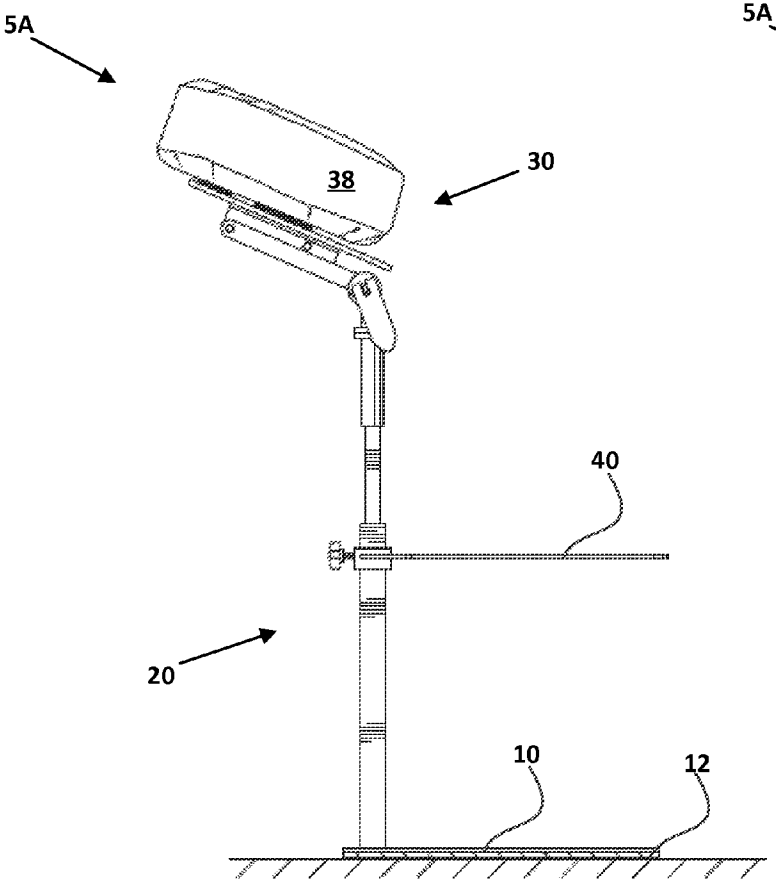
FIG. 3 is a side elevation view of a head support device according to an embodiment in an initial configuration.

FIG. 3 is a side elevation view of a head support device 5A, according to an alternative embodiment, in an initial configuration. FIG. 4 is a side elevation view of the head support device 5A in an adjusted configuration. It will be noted that head support device 5A is the same as head support device 5 in all respects, except head support device 5A further includes a rubberized anti-scratch pad 12 underneath the base component 10 for protecting a floor surface from being scratched by the bottom of base component 10. The anti-scratch pad 12 may be affixed to the underside of base component 10. The arrows in FIG. 4 show some of the degrees of adjustability of the head support device 5A. These degrees of adjustability apply to all embodiments of the invention disclosed herein, including head support device 5 described above.

Figure 5:
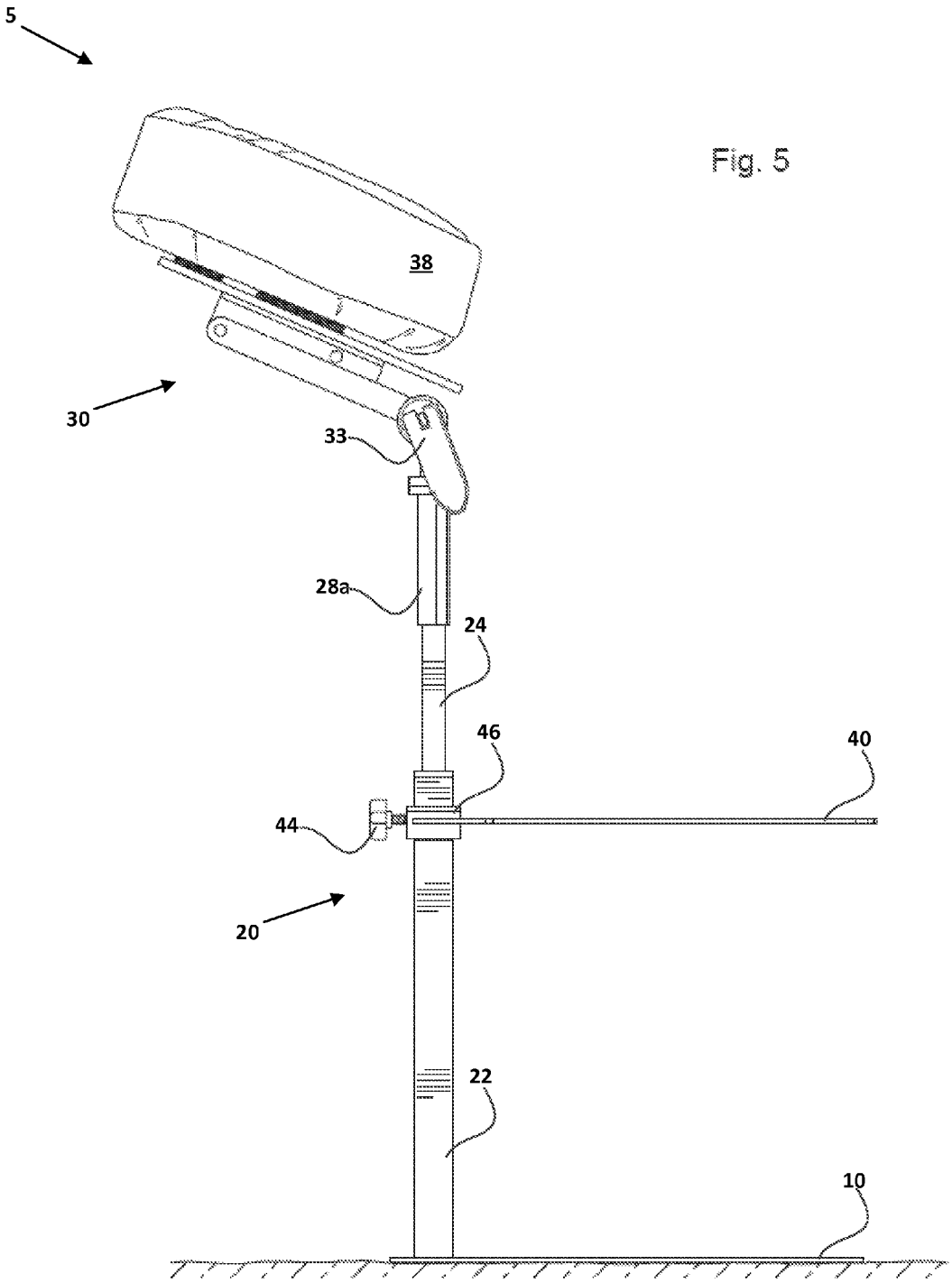
FIG. 5 is a side elevation view of the head support device of FIG. 1.

FIG. 5 is a side elevation view of head support device 5, in a condition ready to interface with a bed.

Figure 6:
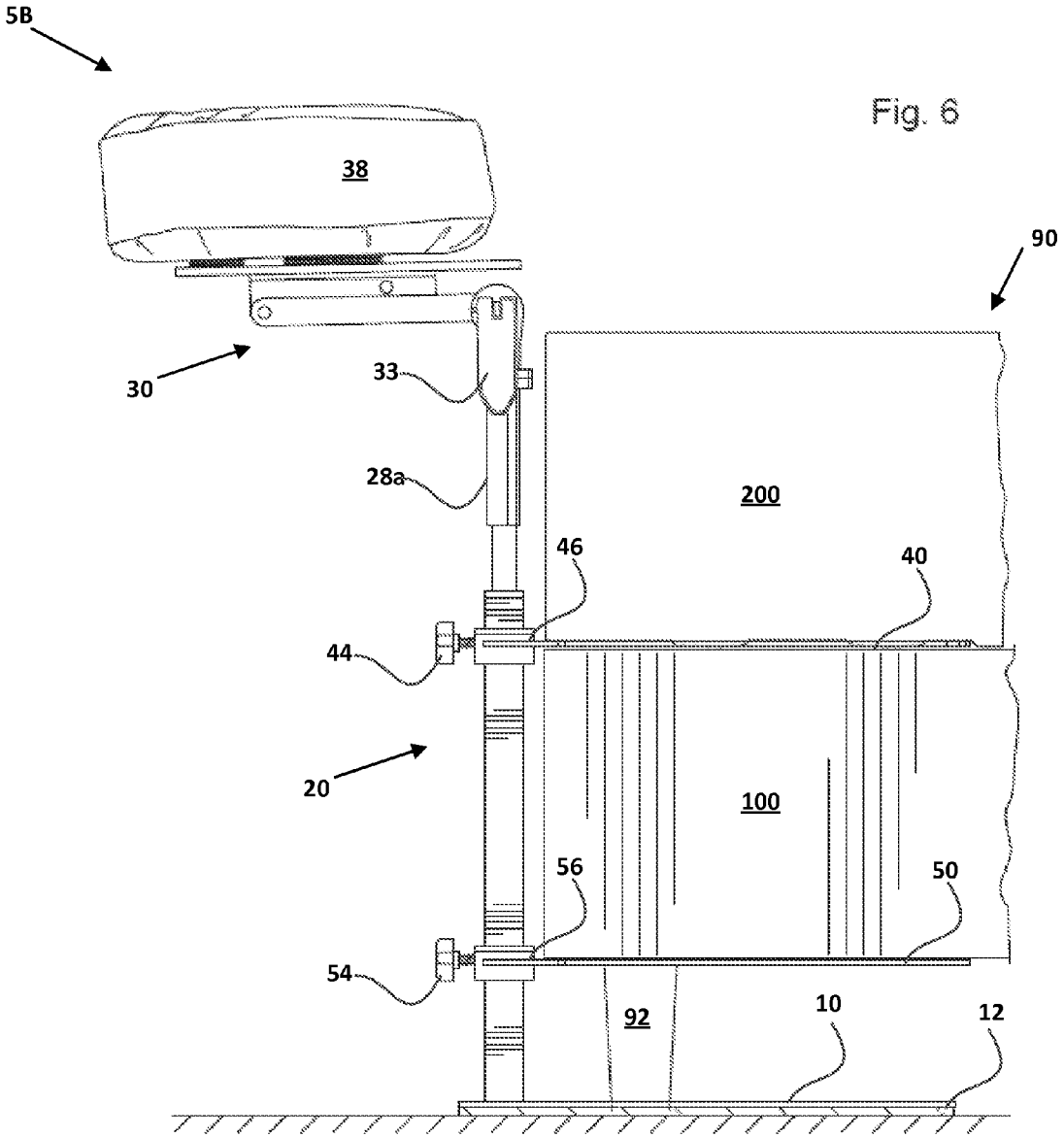
FIG. 6 is a side elevation view of a head support device according to an embodiment in position with respect to a bed.

FIG. 6 is a side elevation view of a head support device 5B according to an alternative embodiment, interfacing with a bed 90. Head support device 5B is very similar to head support devices 5 and 5A, but is different in that it has an additional bed-connection structure 50 extending from an intermediate position along its spine component 20. Like bed-connection structure 40, bed-connection structure 50 extends from the lower spine component 22 of spine component 20. In particular, a square opening 56 through the bed-connection structure 50 corresponds in size to the external dimensions of the square cross-section of the lower spine component 22, and slidingly receives the lower spine component 22. A tension knob 54 affixed to a threaded rod can be used to thread the rod through a sidewall of the square opening 56 to bind against the lower spine component 22, thereby to allow the bed-connection structure 50, which would otherwise be free to slide upwards or downwards with respect to lower spine component 22, to remain in a particular selected position.

In FIG. 6, bed-connection structure 40 is disposed between a mattress 200 and a box spring 100 of bed 90. Bed-connection structure 50 is disposed underneath box spring 100. Depending on the type of bed, bed-connection structure 50 may be disposed between bed frame 92 and box spring 100. Bed-connection structures 40 and 50 may be positioned to "squeeze" box spring 100 from above and below, thereby inhibiting head support device 5B from sliding away from bed 90 during continued use.

Figure 7:
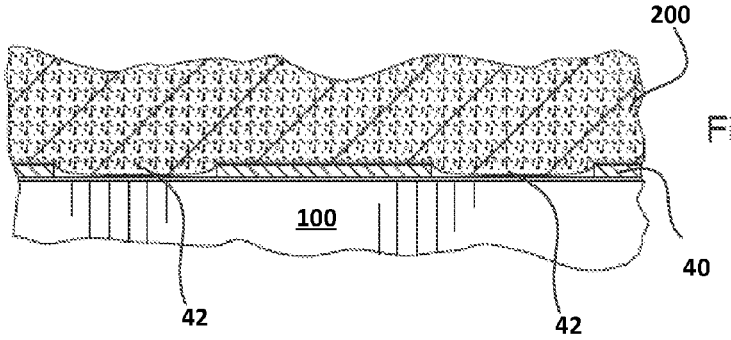
FIG. 7 is an enlarged partial and cross-sectioned view of the interaction of a bed-connection structure of the head support device of FIG. 6 with the bed.

FIG. 7 is an enlarged partial view of the interaction of bed-connection structure 40 of head support device 5B with bed 90. The holes 42 in bed-connection structure 40 receive corresponding portions of the mattress 200 therethrough, due to the non-rigid nature of the bottom surface of the mattress 200 and the influence of internal pressure of mattress stuffing within the mattress 200. The interaction in this way of the mattress 200 and the bed-connection structure 40 further inhibits head support device 5B from sliding away from bed 90 during continued use.

Figure 8:
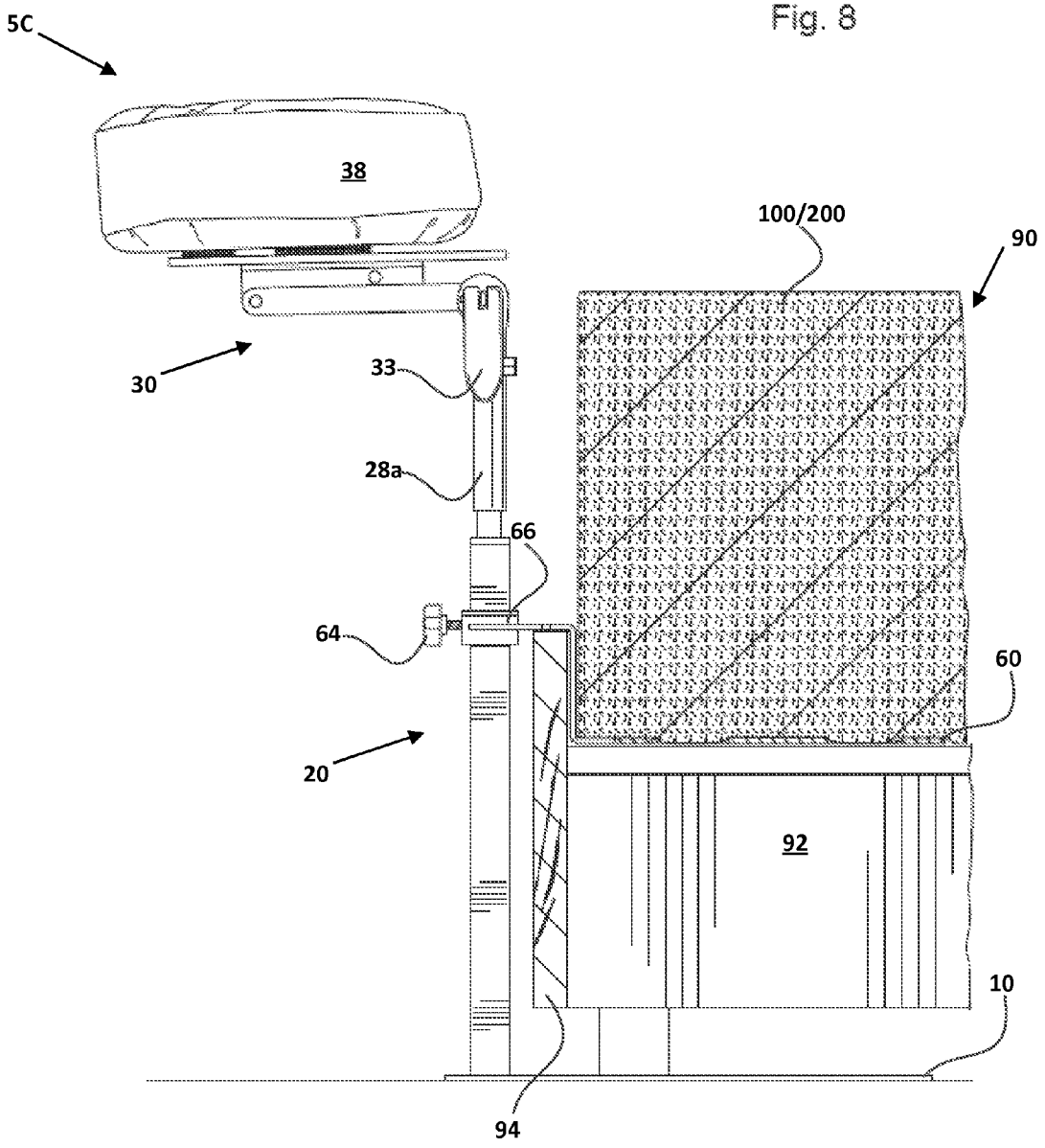
FIG. 8 is a side elevation view of a head support device according to an alternative embodiment in position with respect to a bed.

FIG. 8 is a side elevation view of an alternative head support device 5C, according to an embodiment, interfacing with a bed 90. The bed in FIG. 8 has a footboard 94 that rises upwards from bed frame 92 beyond the height at which mattress or box spring 100/200 meets the bed frame 92. Because of the higher footboard 94, an entirely single-planar bed-connection structure such as bed-connection structure 40 would not interface well with the bed 90. The head support device 5C is very similar to previously-described head supported devices 5, 5A and 5B, except that it incorporates a different bed-connection structure 60.

Like bed-connection structure 40, bed-connection structure 60 extends from the lower spine component 22 of spine component 20. In particular, a square opening 66 through the bed-connection structure 60 corresponds in size to the external dimensions of the square cross-section of the lower spine component 22, and slidingly receives the lower spine component 22. A tension knob 64 affixed to a threaded rod can be used to thread the rod through a sidewall of the square opening 66 to bind against the lower spine component 22, thereby to allow the bed-connection structure 60, which would otherwise be free to slide upwards or downwards with respect to lower spine component 22, to remain in a particular selected position.

Bed-connection structure 60 is stepped so as to first extend outwards over top of a footboard 94, downwards along the inward-facing surface of the footboard 92, and then outwards again along a plane corresponding to the height at which the mattress or box spring 100/200 meets the bed frame. It will be understood that bed-connection structure 60 can be disposed alternatively between a mattress 200 and a box spring 100.

Figure 9A:
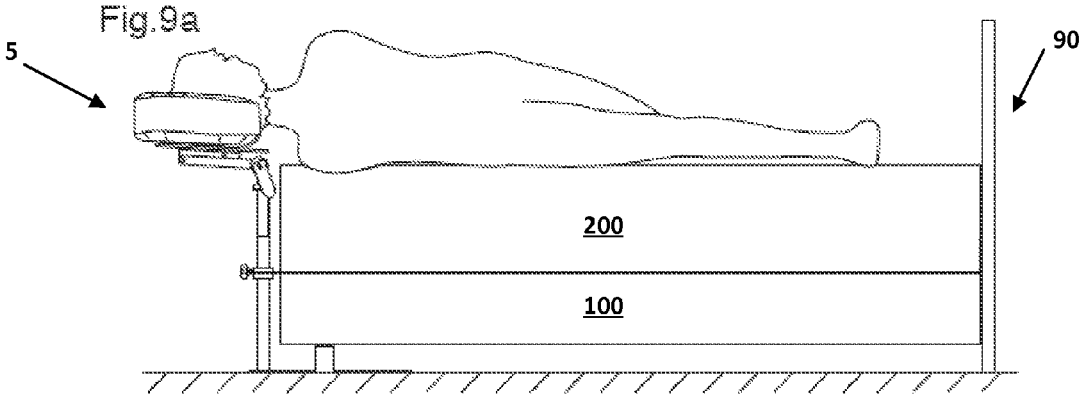
FIGS. 9*a*, 9*b* and 9*c* are side elevation views of the head support device of FIG. 1 in position with respect to a bed, showing various positions of a user and the support of the user's head.
Figure 9B:
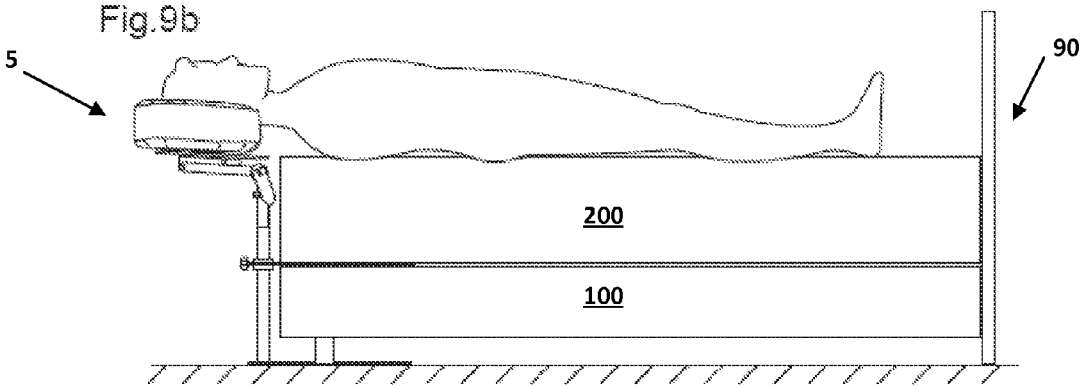
Figure 9C:
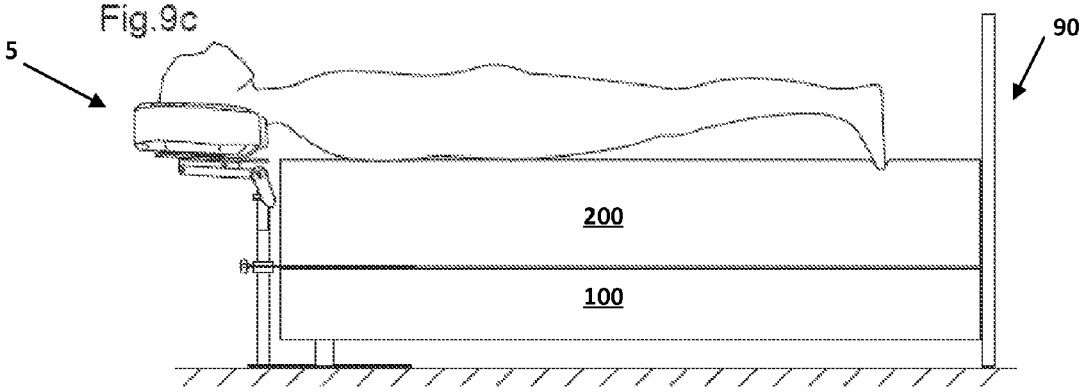

FIGS. 9*a*, 9*b* and 9*c* are side elevation views of the head support device 5 interfacing with a bed 90, and showing various positions of a user and the support of the user's head.

Although embodiments have been described with reference to the drawings, those of skill in the art will appreciate that variations and modifications may be made without departing from the spirit, scope and purpose of the invention as defined by the appended claims.

For example, while the bed-connection structures described herein have single horizontal plates that interface with a mattress and/or box spring, alternative structures extending from the spine component 20, such as multiple horizontal plates, bars or the like may be employed.

Furthermore, while in embodiments the head-receiving structure 38 is removable from support plate 36, in alternative embodiments the head-receiving structure 38 is integrated with or permanently affixed to the support plate 36.

Furthermore, while a push-button structure is employed for height adjustment of the spine component 20, other height adjustment mechanisms may be employed.

Furthermore, while a tension knob has been described for enabling components to remain affixed in position with respect to one another, other mechanisms for doing this may be employed.

Furthermore, while the base component is described as a generally horizontal plate, other structures such as tripods or other suitable base components that are adapted to sit on generally stable surface such as that which supports the bed (or on a surface that is supported by the surface supported by the bed etc.) may alternatively be employed.

What is claimed is:

1. A head support device for use with a bed having a footboard, the device comprising:

a head-receiving component;

a base component adapted to stably rest on a same surface as does the bed;

a vertically-oriented, height-adjustable spine component extending upwards from the base component to the head-receiving component; and at least one bed-connection structure extending horizontally from an intermediate position along the spine component and being stepped from the horizontal by extending downwards along an inward-facing surface of the footboard, and then again horizontally away from the spine component along the bottom of a mattress or box spring of the bed; wherein the head-receiving component comprises levelling structure associated with an axis perpendicular to and supported by the spine component, the levelling structure extending away from the axis to be both rotatable through a range of rotational positions with respect to the axis and, at each one of a plurality of the rotational positions, adjustable between horizontally level and off-level.

2. The head support device of claim 1, wherein the at least one bed-connection structures comprises a horizontal plate.

3. The head support device of claim 1, wherein the at least one bed-connection structure is height-adjustable with respect to the spine component thereby to selectively extend from various positions along the spine component.

4. The head support device of claim 3, wherein the at least one bed-connection structure comprises:

a collar dimensioned to receive the spine component; and a tension knob with a threaded rod for fixing the collar at a selected position along the spine component.

5. The head support device of claim 1, wherein the base component comprises a horizontal plate.

6. The head support device of claim 5, further comprising an anti-scratch pad underneath the base component.

7. The head support device of claim 1, wherein the head-receiving component comprises a U-shaped pad.

8. The head support device of claim 1, wherein the levelling structure is height-adjustable.

9. The head support device of claim 1, wherein the at least one bed-connection structure comprises at least one plate incorporating lateral binding structure.

10. The head support device of claim 9, wherein the lateral binding structure comprises holes through the at least one plate.

* * * * *